US007062894B2

(12) United States Patent
Löffler

(10) Patent No.: US 7,062,894 B2
(45) Date of Patent: Jun. 20, 2006

(54) BEVERAGE BOTTLING PLANT FOR FILLING BOTTLES WITH A LIQUID BEVERAGE FILLING MATERIAL, AND A CONTAINER FILLING PLANT CONTAINER INFORMATION ADDING STATION, SUCH AS, A LABELING STATION HAVING A SLEEVE LABEL CUTTING ARRANGEMENT, CONFIGURED TO ADD INFORMATION TO CONTAINERS, SUCH AS, BOTTLES AND CANS

(75) Inventor: Horst Löffler, Königsbronn (DE)

(73) Assignee: KHS Maschinen-und Anlabenbau AG, Dortmund (DE)

( * ) Notice: Subject to any disclaimer, the term of this patent is extended or adjusted under 35 U.S.C. 154(b) by 139 days.

(21) Appl. No.: 10/793,659

(22) Filed: Mar. 4, 2004

(65) Prior Publication Data

US 2004/0238065 A1 Dec. 2, 2004

(30) Foreign Application Priority Data

Mar. 5, 2003 (DE) ..... P 103 09 459

(51) Int. Cl.
*B65B 11/00* (2006.01)

(52) U.S. Cl. ..... 53/585; 53/567; 141/145; 141/168

(58) Field of Classification Search ..... 141/2, 141/18, 129, 144–147, 156, 168; 53/557, 53/585, 441, 567
See application file for complete search history.

(56) References Cited

U.S. PATENT DOCUMENTS 4,208,857 A * 6/1980 Fujio ..... 53/585
5,713,403 A * 2/1998 Clusserath et al. ..... 141/101

* cited by examiner

*Primary Examiner*—Timothy L. Maust
(74) *Attorney, Agent, or Firm*—Nils H. Ljungman & Associates

(57) ABSTRACT

A beverage bottling plant for filling bottles with a liquid beverage filling material, a container filling plant, a closing station, a container information adding station in the form of a labeling station having a electromagnetic operated sleeve label cutting arrangement, the station being configured to add information to containers in the form of bottles and cans.

20 Claims, 5 Drawing Sheets

FIG. 1
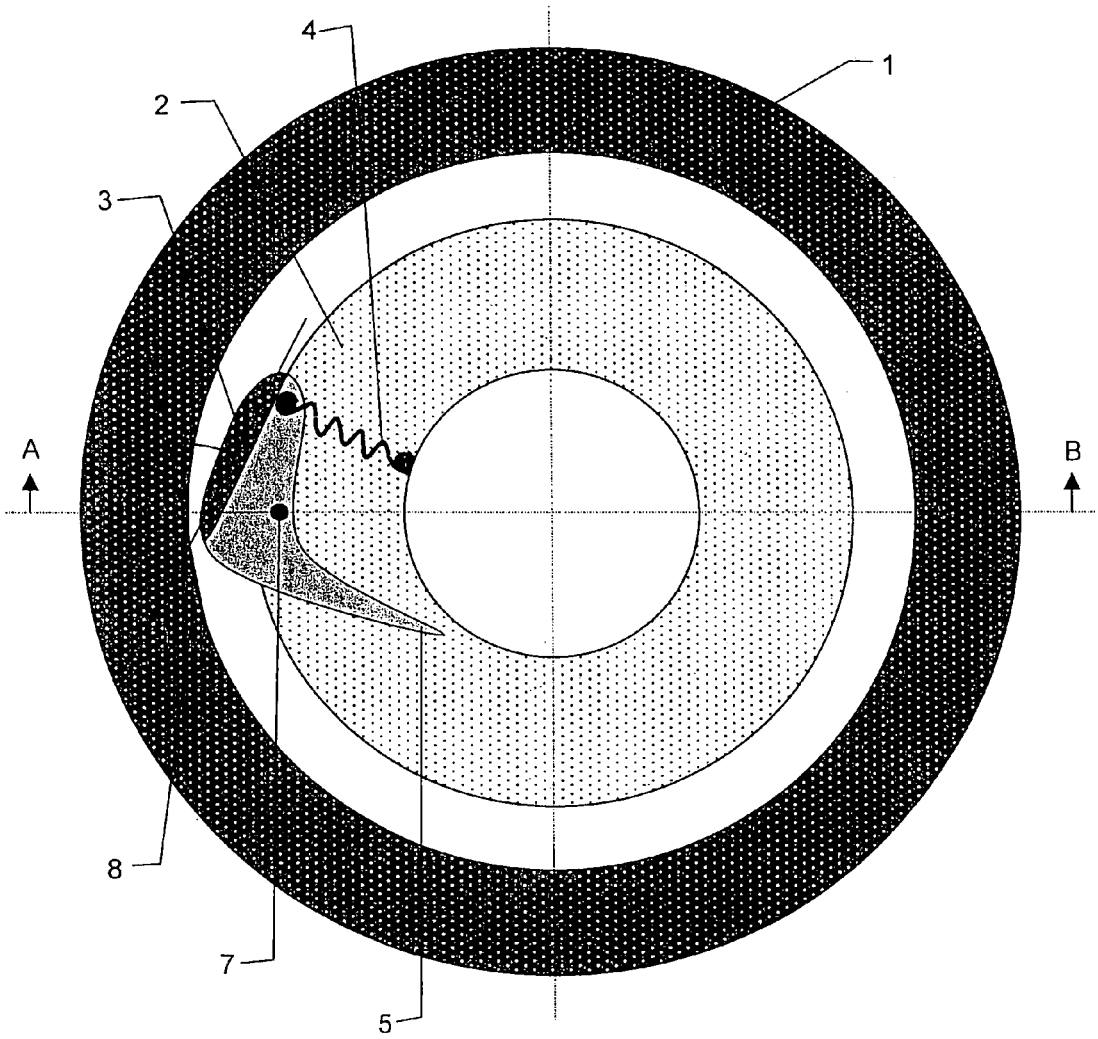
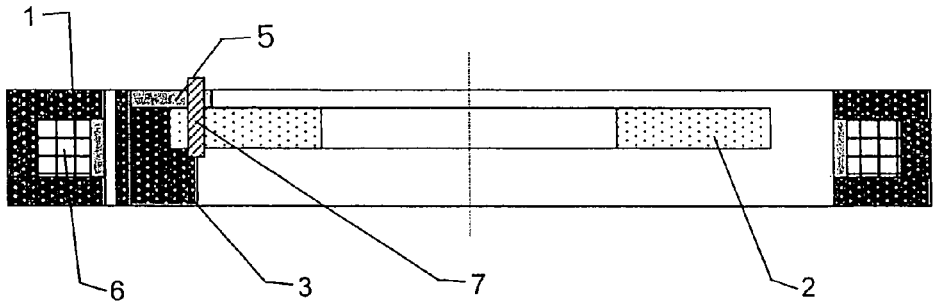
FIG. 2

BEVERAGE BOTTLING PLANT FOR FILLING BOTTLES WITH A LIQUID BEVERAGE FILLING MATERIAL, AND A CONTAINER FILLING PLANT CONTAINER INFORMATION ADDING STATION, SUCH AS, A LABELING STATION HAVING A SLEEVE LABEL CUTTING ARRANGEMENT, CONFIGURED TO ADD INFORMATION TO CONTAINERS, SUCH AS, BOTTLES AND CANS

BACKGROUND

1. Technical Field

The application relates to a beverage bottling plant for filling bottles with a liquid beverage filling material, and a container filling plant container information adding station, such as, a labeling station having a sleeve label cutting arrangement, configured to add information to containers, such as, bottles and cans.

2. Background Information

A beverage bottling plant for filling bottles with a liquid beverage filling material can possibly comprise a beverage filling machine with a plurality of beverage filling positions, each beverage filling position having a beverage filling device for filling bottles with liquid beverage filling material. The filling devices may have an apparatus being configured to introduce a predetermined volume of liquid beverage filling material into the interior of bottles to a substantially predetermined level of liquid beverage filling material, and the apparatus configured to introduce a predetermined flow of liquid beverage filling material comprising apparatus being configured to terminate the filling of beverage bottles upon liquid beverage filling material reaching said substantially predetermined level in bottles. There may also be provided a conveyer arrangement being configured and disposed to move bottles, for example, from an inspecting machine to the filling machine. Upon filling, a closing station closes filled bottles. There may further be provided a conveyer arrangement configured to transfer filled bottles from the filling machine to the closing station; as well as a loading station that is configured to load filled bottles into containers, for example, in a six-pack arrangement. There may also be provided a conveyor arrangement configured to transfer filled bottles from the closing station to the loading station.

In the packaging of wares of diverse sorts, such as, for example, beverages or items of food, it has been found highly advantageous to configure the containers in which such wares are offered as advantageously and appealingly as possible. Aside from configuration of the body of containers, the container labeling, that is ever increasing in display, also plays an increasingly important role.

For the identification of containers that are symmetrical with reference to an axis of rotation, such as, bottles or cans, aside from other types of labels, also labels are used that are introduced to the labeling station in the form of an endless tube that is made of a thin elastic plastic. This tube is initially disposed as a flat folded band as a roll on a roller. Prior to positioning on the container that is to be labeled, the label tube needs to be widened to a round configuration and needs to be cut in accordance with the label length. For this, the cutting device rotates about the label tube that has been placed onto a round mandrel and respectively severs a label, while the introduced tube is for a moment at a still-stand. The cut label is then pulled, just like a stocking, over the container and tightly adheres, due to its elasticity, to the outer surface of the container.

Modern labeling stations process several ten-thousands of units per hour. Thus, for cutting of a label, including all the associated transport and positioning procedures, there is available a time of less than 100 milliseconds.

Known cutting devices operate with an arrangement comprising a round disc that rotates about the label tube, which disc carries a plurality of knives. The knives are connected to an additional mass as well as to a return spring. The number of revolutions of the disc is changed by the drive means between two values, a low value, in which the cutting knives do not contact the label tube (rest position) and a higher value, in which the knives are swung into the cutting position. For this, the masses that are connected to the knife and the spring forces are dimensioned in such a way that at a low number of revolutions the force of the spring applies as the greater force and the spring holds the knife in the rest position, while at a higher number of revolutions, the centrifugal force of the mass that is connected to the knife applies as the greater force and the knife is swung into the cutting position.

Disadvantages of the known arrangement reside in the high periodic forces that are required for acceleration and for deceleration of the entire mass of the knife-holder together with the knives between the two numbers of revolutions, as well as the time periods that are required for the acceleration procedures. The acceleration time periods are not available for the actual cutting as such. Since an increase of the frequency of cutting can only be achieved by raising the motor effort or, respectively, a lowering of the masses that need to be accelerated, the cutting step limits the operating frequency of the entire labeling station.

OBJECT

One object of an embodiment described below is to solve the problems encountered on similar apparatus of the prior art.

SUMMARY

One feature or aspect of an embodiment is believed at the time of the filing of this patent application to possibly reside broadly in a beverage bottling plant for filling bottles with a liquid beverage filling material, said beverage bottling plant comprising: a filling machine being configured to fill empty bottles with liquid beverage filling material; a conveyer arrangement being configured and disposed to move empty bottles to said filling machine; said beverage filling machine comprising a plurality of beverage filling positions, each beverage filling position comprising a beverage filling device for filling bottles with liquid beverage filling material; said filling devices comprising apparatus being configured to introduce a predetermined volume of liquid beverage filling material into the interior of bottles to a substantially predetermined level of liquid beverage filling material; said apparatus being configured to introduce a predetermined volume of liquid beverage filling material comprising apparatus being configured to terminate the filling of beverage bottles upon liquid beverage filling material reaching said substantially predetermined level in bottles; a closing station being configured and disposed to close filled bottles; a conveyer arrangement being configured and disposed to transfer filled bottles from said filling machine to said closing station; a labeling station being configured and disposed to receive bottles to be labeled; a conveyer arrangement being configured and disposed to convey bottles to said labeling station; said labeling station comprising: a storage being configured and disposed to store a continuous collapsed tube of flat uncut sleeve labels disposed sequentially one after the other; a mandrel structure; said mandrel structure being configured to open a continuous collapsed tube of uncut sleeve labels; said mandrel structure having a receiving end and a discharge end remote from said receiving end; a first set of roller apparatus being configured and disposed to advance an opened continuous tube of uncut sleeve labels along said mandrel structure from said receiving end towards said discharge end; said first set of roller apparatus being disposed adjacent said receiving end of said mandrel structure; a second set of roller apparatus being configured and disposed to advance an opened continuous tube of uncut sleeve labels along said mandrel structure to said discharge end; said second set of roller apparatus being disposed between said first set of roller apparatus and said discharge end of said mandrel structure; apparatus being configured and disposed to cut an open sleeve label from an opened continuous tube of uncut open sleeve labels to thus produce a cut open sleeve label for a bottle disposed at said discharge end of said mandrel structure; said cutting apparatus comprising a rotating disc having at least one sleeve cutting knife operatively connected thereto; each said at least one sleeve cutting knife being configured and disposed to be moved between a position of rest and a position of cutting; each said at least one sleeve cutting knife comprises a portion configured to move said at least one sleeve cutting knife into the cutting position, and also comprises a structure to move said at least one sleeve cutting knife into the rest position; said cutting apparatus also comprising at least one electromagnet configured and disposed to move said at least one sleeve cutting knife into the cutting position; said cutting apparatus being disposed between said first set of roller apparatus and said second set of roller apparatus; said mandrel structure comprising an expander apparatus being configured and disposed to sufficiently expand a portion of an uncut open sleeve label, immediately adjacent said cutting apparatus, between said first set of roller apparatus and said second set of roller apparatus, to make taut a portion of an opened tube of uncut open sleeve labels adjacent said cutting apparatus and thus to minimize bunching of an opened continuous tube of uncut open sleeve labels on said mandrel structure, and also to maximize precision of the cut being effectuated by said cutting apparatus; said second set of roller apparatus also being configured and disposed to remove a cut open sleeve label from said mandrel structure with sufficient velocity and to position a cut open sleeve label about a bottle disposed at said discharge end of said mandrel structure, and thus to permit a constant cut of a sleeve label being cut and elevated cutting speeds to afford shorter cycle times; and said bottling plant further comprising: apparatus being configured and disposed to affix a cut open sleeve label, positioned by said second set of roller apparatus about a bottle, to the surface of a bottle.

Another feature or aspect of an embodiment is believed at the time of the filing of this patent application to possibly reside broadly in the device that avoids the mentioned disadvantages in that the knife-holder rotates with a constant number of revolutions and the knifes can be configured in a much more simple design since additional masses for generation of defined centrifugal forces are absent.

The above-discussed embodiments of the present invention will be described further hereinbelow. When the word "invention" or "embodiment of the invention" is used in this specification, the word "invention" or "embodiment of the invention" includes "inventions" or "embodiments of the invention", that is the plural of "invention" or "embodiment of the invention". By stating "invention" or "embodiment of the invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

BRIEF DESCRIPTION OF THE DRAWINGS

FIG. 1 is a horizontal cross-sectional view of a cutting knife actuating arrangement principle in accordance with one embodiment of the present application;

FIG. 2 is an elevational cross-sectional view along line A–B of the arrangement in accordance with FIG. 1.

DESCRIPTION OF EMBODIMENT OR EMBODIMENTS

Figure 1A:
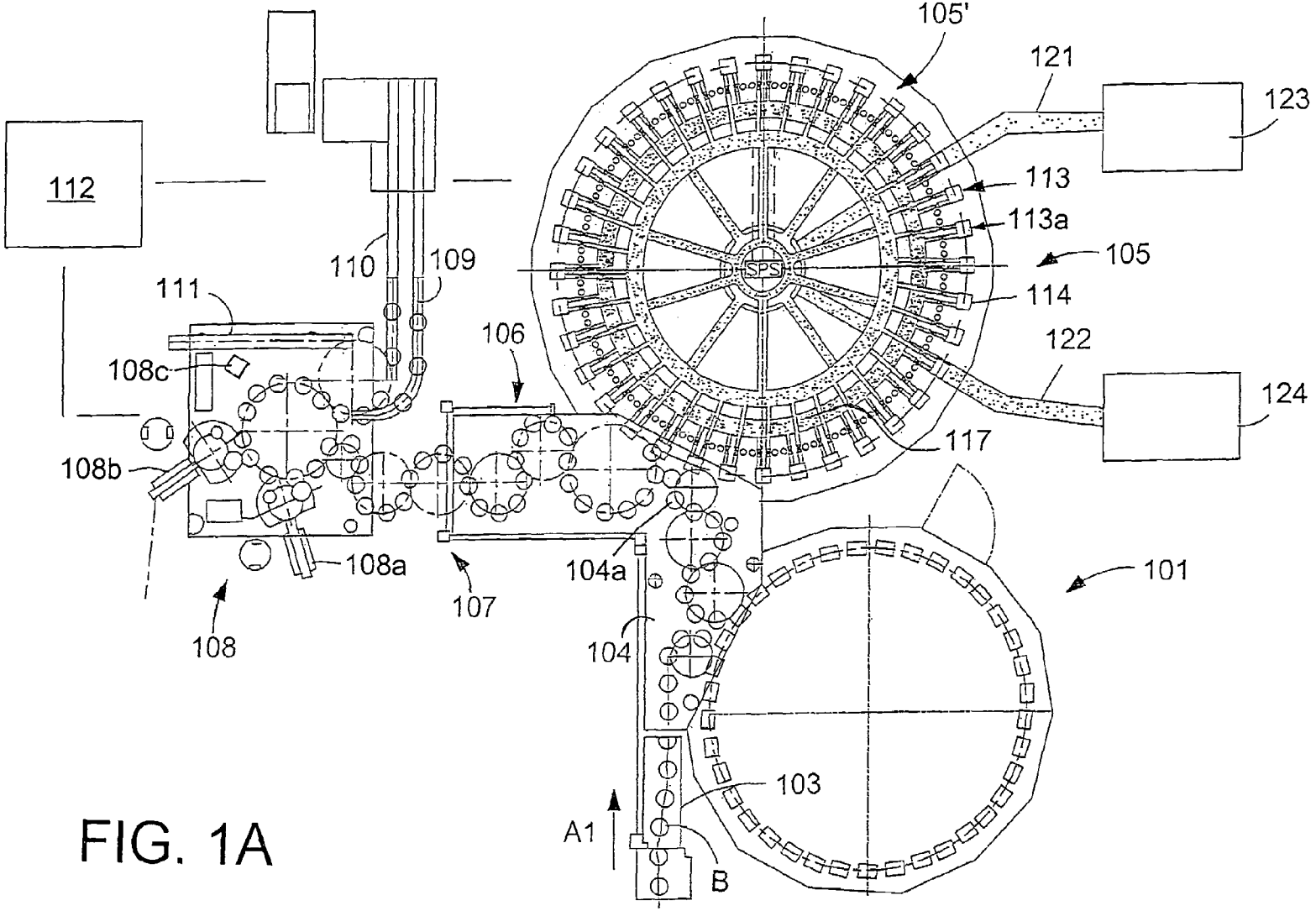
FIG. 1A is a schematic illustration of a container filling plant in accordance with one embodiment of the present application.

FIG. 1A shows schematically the main components of one embodiment example of a system for filling containers, specifically, an embodiment of a beverage bottling plant 100 for filling bottles B with liquid beverage filling material, in accordance with one embodiment, or in which system or plant could possibly be utilized at least one aspect, or several an aspects, of the embodiments disclosed herein.

FIG. 1A shows a rinser or rinser station 101, to which the containers, namely bottles B, are fed in the direction of travel as is indicated by the arrow A, by means of a conveyer line or conveyer arrangement 103, and downstream of rinser station 101, in the direction of travel as is indicated by the arrow A, the rinsed bottles B are transported to a beverage filling machine 105 by means of a conveyer line or conveyer arrangement 104 that is formed, for example, by a star wheel conveyer or a plurality of star wheels of a conveyer arrangement. The conveyer arrangement 104 may possibly have a star wheel 104*a* that introduces bottles B to the filling machine 105.

Downstream of the filling machine 105, in the direction of travel of the bottles B, there can preferably be a closer or closer station 106 which closes the bottles B.

The closer or closer station 106 can, for example, be connected directly to a labeling device or labeling station 108, such as, for example, by means of a conveyer line or conveyer arrangement 107 that may be formed, for example, by a plurality of star wheels of a conveyer arrangement.

In the illustrated embodiment, the labeling device or labeling machine or labeling station 108 has, for example, three outputs, namely one output formed by a conveyer or conveyer arrangement 109 for bottles B that are filled with a first product. The first product may possibly be provided by a product mixer 123 that is connected to the filling machine 105, for example, through a conduit 121, and bottles B that are filled with a predetermined volume of liquid beverage filling material, that is, the first product, are then labeled by a labeling module 108*a* in the labeling stations 108 corresponding to this first product delivered from product mixer 123 to the beverage filling machine 105 and thence to the corresponding bottles B.

A second output that is formed by a conveyer or conveyer arrangement 110 is provided for those bottles B that are filled with a second product. The second product may emanate from a second product mixer 124 that is connected, for example, through a conduit 122 to the filling machine 105, and these bottles B filled with a predetermined volume of liquid beverage filling material comprising the second product are then correspondingly labeled by a labeling module 108*b* in the labeling station 108 corresponding to this second product.

A third output, for example, formed by a conveyer or conveyer arrangement 111, removes any bottles B which have been incorrectly labeled as may have been determined by an inspecting device or an inspecting station, or an inspecting module 108*c* that may possibly form a part of the labeling station 108.

In FIG. 1A item 112 is a central control unit or, expressed differently, a controller or a system which includes a process controller that, among other things, controls the operation of the above-referenced system or plant.

The beverage filling machine 105 is preferably of the revolving design, with a rotor 105', which revolves around a vertical machine axis. On the periphery of the rotor 105' there are a number of filling positions 113, each of which comprises bottle carriers or container carriers 113*a* that are configured and disposed to present bottles B for filling, as well as a filling device or element or apparatus 114 located or configured to be located above the corresponding container carrier 113*a* and the corresponding bottle B presented by the carrier 113*a*. The filling device or apparatus 114 comprises an apparatus configured to introduce a predetermined volume of liquid beverage filling material into the interior of bottles B to a predetermined level of liquid beverage filling material. Furthermore, the filling device or apparatus comprises an apparatus configured to terminate the filling of bottles upon liquid beverage filling material reaching the predetermined level in bottles B. In other words, filling elements 114 are configured and disposed to provide a predetermined flow of liquid beverage filling material from the source thereof, such as, product mixers 123 and 124, into the bottles B.

The toroidal vessel 117 is a component, for example, of the revolving rotor 105'. The toroidal vessel 117 can be connected by means of a rotary coupling or a coupling that permits rotation, and by means of an external connecting line 121 to the external reservoir or product mixer 123 to supply the product, that is, product mix 1, for example.

As well as the more typical filling machines having one toroidal vessel, it is possible that in at least one possible embodiment a filling machine could possibly be utilized wherein each filling device 114 is preferably connected by means of two connections to a toroidal vessel 117 which contains a first product, say by means of a first connection, for example, 121, and to a second toroidal vessel which contains a second product, say by means of the second connection, for example, 122. In this case, each filling device 114 can also preferably have, at the connections, two individually-controllable fluid or control valves, so that in each bottle B which is delivered at the inlet of the filling machine 105 to a filling position 113, the first product or the second product can be filled by means of an appropriate control of the filling product or fluid valves.

It will be understood that while a two-product assembly or system of a bottling plant is illustrated in FIG. 1A, the disclosure is equally applicable to single-product installations, or other commensurate embodiments.

Figure 1B:
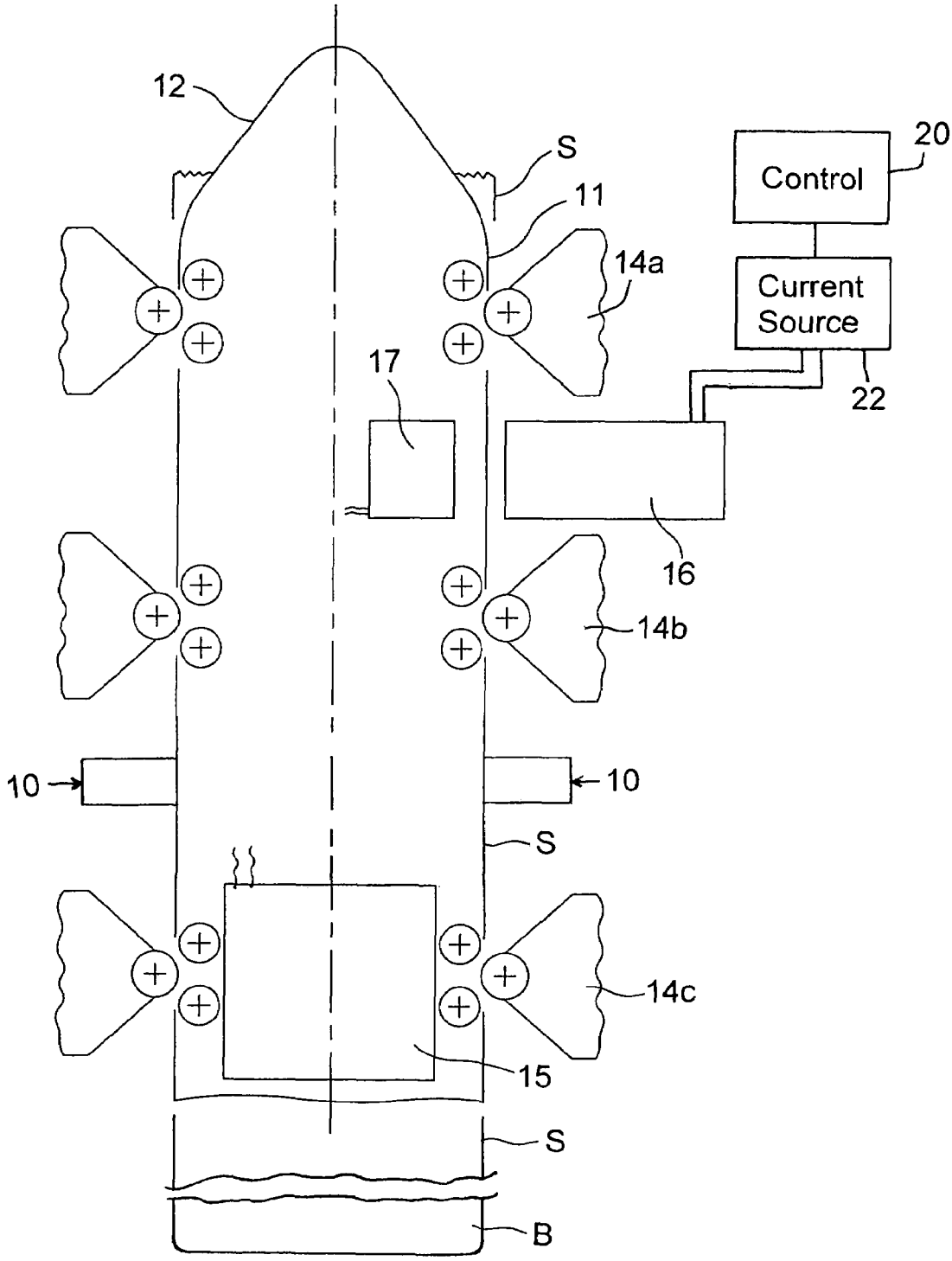
FIG. 1B illustrates the arrangement for advancing a sleeve label tube on a mandrel in accordance with one embodiment of the present application.

With reference to FIG. 1B there is illustrated a mandrel structure 11 that has a conical receiving end 12 for receiving a portion of a sleeve label tube S that is advanced by roller arrangements 14*a*, 14*b*, and 14*c* along the body of the mandrel 11 towards a bottle B that is to receive a cut sleeve label S. The mandrel 11 is surrounded by a cutting arrangement 10 that is disposed between roller arrangements 14*b* and 14*c*. The mandrel may be of an expanding type with pressure bodies, not shown in particular details that may possibly be actuated through energy stored in an accumulator 15, or several accumulators, for electrical energy within the mandrel 11. With such an arrangement it is of particular advantage that the at least one accumulator 15 be disposed at the lower end of the mandrel 11. This permits that the accumulator 15 can be exchanged without dismantling of the mandrel 11 or, respectively, without removal of the label tube S from the mandrel 11 or, respectively, the removal of the mandrel 11 from the labeling station.

A further approach of the delivery of energy to the mandrel 11 resides therein that electrical energy is transferred into the mandrel 11 by way of induction. In this method, a transmitter 16 of induction energy is disposed at the labeling machine. The interior of the mandrel 11 houses a receiver 17 for induction energy and the receiver 17 captures the electromagnetic pulses that are emitted by the transmitter 16 of induction energy, and converts the sent electromagnetic impulses again into electrical energy.

The arrangement shown in FIG. 1B includes a source for the supply of current 22 and a control arrangement 20 for control of the sleeve label handling arrangement in accordance with FIG. 1B.

Figure 3:
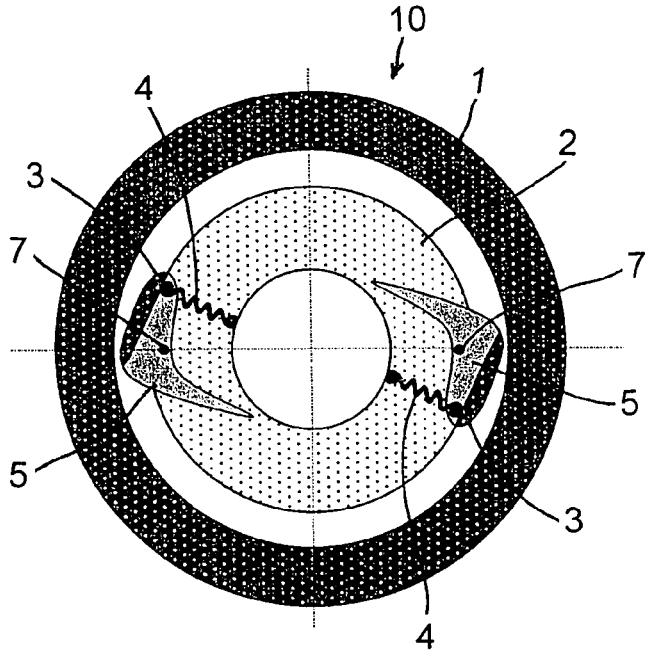
FIG. 3 is a view similar to FIG. 1 and showing two cutting knives in accordance with one embodiment of the present application.

With reference to FIGS. 1 and 2, a disc 2 rotating with a constant number of revolutions, made of non-ferromagnetic material, for example, aluminum or plastic, carries the knife 5. In the drawing, only one knife is shown. In order to further reduce the time required for cutting and so as to minimize journal stresses, a symmetrical arrangement of a plurality of knives is sensible, compare FIG. 3, showing a pair of symmetrically disposed knives 5.

The knife can rotate about axis 7 and is maintained in the rest position by spring 4. The knife axis 7 is secured on the rotating support disc 2. The point of rotation of the knife is selected in such a way that the centrifugal forces on either side of the axis of rotation are of approximately equal magnitude. This precludes a moment about the axis of rotation of the knife due to centrifugal force. At the periphery, the knife carries a flag 3 made of soft-magnetic material.

Concentrically about the rotating knife-holder ring there is disposed a ring 1 made of soft-magnetic material and having a U-shaped cross-section, into which is embedded an annular coil 6. So as to prevent soiling, the coil is cast into place or covered by plastic ring. The soft-magnetic ring together with the annular coil 6 and the flag 3 configures an electromagnet.

In the rest position, the longitudinal axis of the flag 3 is not disposed parallel to the tangent line 8 at the point of intersection with the soft-iron ring. When current flows through the coil, the attendantly resulting field forces attempt to minimize the volume of the air gap between the flag 3 and ring 1. This means that the knife 5 rotates, reduces the angle between the longitudinal axis of the flag 3 and the tangent line 8, and, accordingly, swings into the cutting position. The outer radius of the flag that is directed towards the annular magnet is selected in such a way, that there is generated, in the cutting position, a parallel air gap of a few tenths of a millimeter.

Upon flow of current to the coil being disconnected, the knife swings back into the rest position due to the tension of the spring 4 while in the cutting position. In place of the spring 4 care can be taken by mass distribution about the axis of rotation of the knife that the centrifugal force that is generated during rotation, a moment is generated that returns the knife into the rest position. The reach of movement can be limited by mechanical stops at both ends.

The advantages of the device in accordance with one aspect of the application are provided by the constant number of revolutions of the knife holder 2 and the low necessary effort required for moving of the knife.

The constant number of revolutions of the knife holder 2 in the device in accordance with one aspect of the application can be selected to be greater than that in the arrangement of the described know arrangement.

Acceleration and deceleration times of the knife-disc are made superfluous.

The light knife can be moved rapidly in the device in accordance with one aspect of the application.

The annular magnet can simultaneously move a plurality of knives into the cutting position.

Altogether, this allows a higher cutting frequency than is the case in the described known arrangement.

Figure 4:
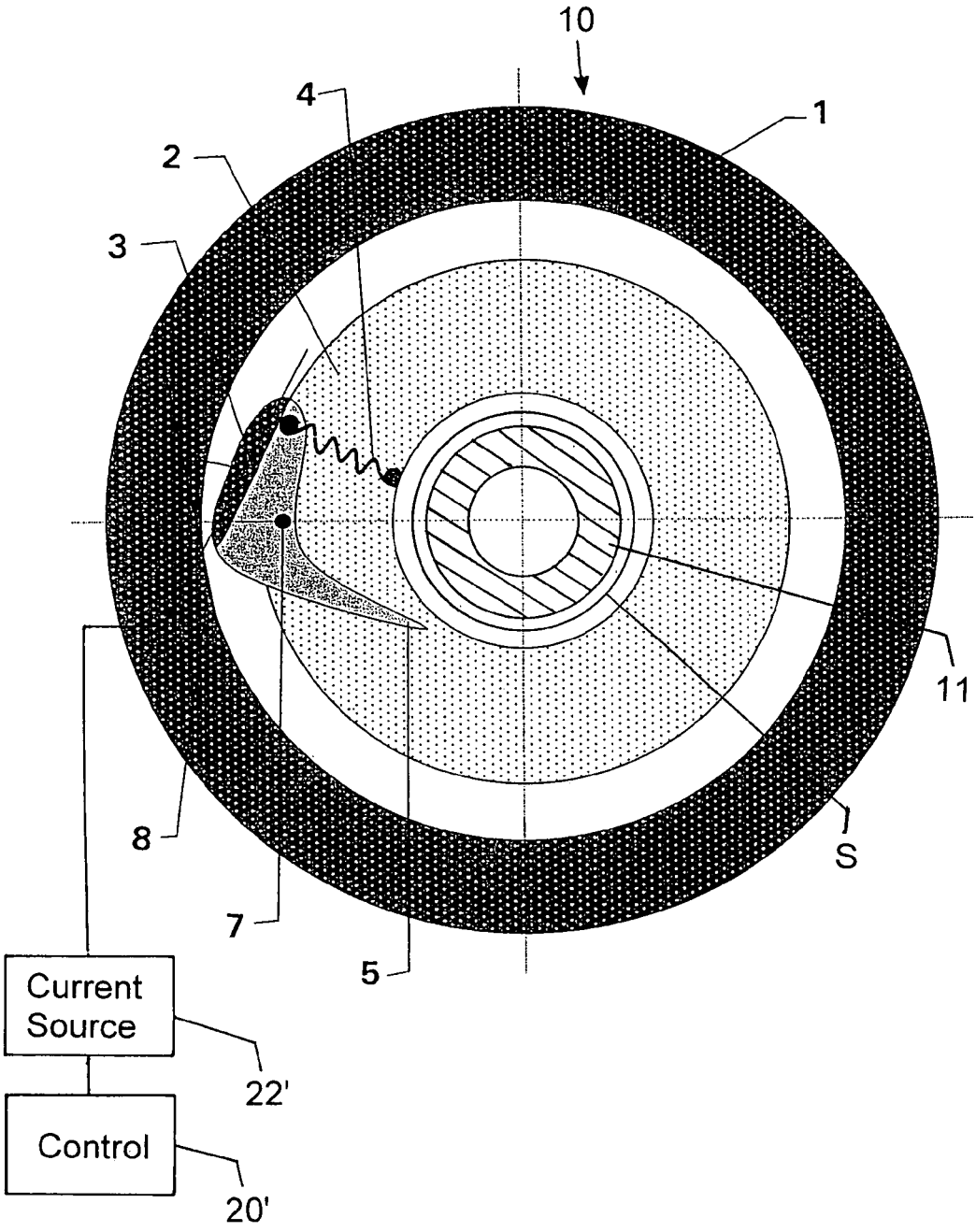
FIG. 4 is another view similar to FIG. 1 and showing one cutting knife, a control and current source in accordance with one embodiment of the present application.

With reference to FIG. 4, there is illustrated a view similar to FIG. 1 in which the cutting arrangement 10 is shown with respect to the central mandrel structure 11 and a sleeve label S that is shown for the purpose of clarity a distance away from the mandrel structure 11. The cutting arrangement 10 comprises a source of current 22' and a control arrangement or system 20' to control the operation of the magnets that are part of the cutting arrangement 10 and to control the cutting arrangement 10.

In one respect, soft magnetic materials are those materials that are easily magnetized and demagnetized. They typically have intrinsic coercivity less than 1000 $Am^{-1}$. They are used primarily to enhance and/or channel the flux produced by an electric current. The main parameter, often used as a figure of merit for soft magnetic materials, is the relative permeability ($m_r$, where $m_r=B/m_oH$), which is a measure of how readily the material responds to the applied magnetic field. The other main parameters of interest are the coercivity, the saturation magnetization and the electrical conductivity.

The types of applications for soft magnetic materials fall into two main categories: AC and DC. In DC applications the material is magnetized in order to perform an operation and then demagnetized at the conclusion of the operation, e.g., an electromagnet on a crane at a scrap yard will be switched on to attract the scrap steel and then switched off to drop the steel. In AC applications the material will be continuously cycled from being magnetized in one direction to the other, throughout the period of operation, e.g., a power supply transformer. A high permeability will be desirable for each type of application but the significance of the other properties varies.

For DC applications the main consideration for material selection is most likely to be the permeability. This would be the case, for example, in shielding applications where the flux must be channeled through the material. Where the material is used to generate a magnetic field or to create a force then the saturation magnetization may also be significant.

For AC applications the important consideration is how much energy is lost in the system as the material is cycled around its hysteresis loop. The energy loss can originate from three different sources: 1. hysteresis loss, which is related to the area contained within the hysteresis loop; 2. eddy current loss, which is related to the generation of electric currents in the magnetic material and the associated resistive losses and 3. anomalous loss, which is related to the movement of domain walls within the material. Hysteresis losses can be reduced by the reduction of the intrinsic coercivity, with a consequent reduction in the area contained within the hysteresis loop. Eddy current losses can be reduced by decreasing the electrical conductivity of the material and by laminating the material, which has an influence on overall conductivity and is important because of skin effects at higher frequency. Finally, the anomalous losses can be reduced by having a completely homogeneous material, within which there will be no hindrance to the motion of domain walls.

It will be appreciated that the weight of a knife 5 and the weight of the portion or flag 3 in at least one possible embodiment are balanced about axis 7 to permit attainment of a proper cutting position of the knife 5 and attainment of a proper rest position of the knife 5 upon cutting having been effectuated.

It will also be appreciated that in at least one embodiment the application balance or weight or mass of the magnetic material portion or flag 3 could be smaller than as is particularly shown in FIG. 2 of the drawings for the purpose of improving the balance about axis 7 to permit attainment of a proper cutting position of the knife 5 and attainment of a proper rest position of the knife 5 upon cutting having been effectuated.

In at least one embodiment, the surrounding ring 1 may comprises a plurality of circumferentially distributed magnets wherein adjacent magnets are disposed with their like poles all being disposed towards the center of the cutting apparatus or arrangement 10.

It will be appreciated that in at least one possible embodiment of the invention, flag or weight 3 of knife 5 may have a portion that is made of a permanent magnet material.

The operation of the knife 5 to move into the cutting position to cut a sleeve label S and to move into the rest position, upon cutting having been effectuated, could possibly be effectuated by a change of the polarity of an electromagnet disposed on ring 1, for example, from the north pole of the ring electromagnet 1 facing towards the center of the cutting apparatus 10 and the south pole of the ring electromagnet 1 facing outwardly and then changing the polarity of the ring electromagnet 1 so that the south pole of the ring electromagnet 1 is facing inwardly towards the center of the cutting apparatus 10 and the north pole of the ring electromagnet 1 is facing outwardly.

Preferably the permanent magnet material portion of flag or weight 3 would then have its north pole disposed towards the ring electromagnet 1 and its south pole facing towards the center of the cutting apparatus 10. Alternatively, the permanent magnet material portion of flag or weight 3 could have its north pole disposed towards the center of the cutting apparatus 10 and its south pole facing towards the ring electromagnet 1.

The change of the polarity of the ring electromagnet 1 from the north pole of the ring electromagnet 1 facing towards the center of the cutting apparatus 10 to the south pole of the ring electromagnet 1 facing towards the center of the cutting apparatus 10 would possibly be accomplished by a current flowing through the ring electromagnet 1 being reversed from one direction to the opposite direction.

Therefore in the case where the permanent magnet material portion of flag or weight 3, in the case where the permanent magnet material portion of flag or weight 3 has its north pole facing outwardly while the ring electromagnet 1 has its south pole facing inwardly, the north pole of the permanent magnet material portion of the flag or weight 3 would be attracted by the south pole of the ring electromagnet 1 to thus set the knife 5 to the cutting position. Upon the current in the ring electromagnet 1 being reversed, such that the north pole of the ring electromagnet 1 would repel the north pole of the permanent magnet material portion of flag or weight 3 of 3*a* therefore pulling the knife 5 from the cutting position into the rest position.

In a possible embodiment as just described, stops would be suitably disposed adjacent the knife 5 to limit the movement of the knife 5 within predetermined limits or limits that are readily determined by experimentation for a given size of a tube of sleeve labels S.

In at least one embodiment of the arrangement just described, the repulsion between like poles of the ring electromagnet 1 and of the permanent magnet material or portion may accordingly provide the biasing of knife 5 away from the cutting position.

In one possible embodiment of the invention, a plurality of electromagnets may be disposed in a circular pattern, such as, spokes of a wheel, about the mandrel 11, with like poles of adjacent electromagnets pointing in the same radial direction. The polarity of such electromagnets can then be changed as described.

One feature or aspect of an embodiment is believed at the time of the filing of this patent application to possibly reside broadly in a device for defined cutting of labels that are introduced as endless tube, comprising a rotating disc with one or a plurality of knives, that each can be moved between a position of rest and a cutting position, characterized in that each knife is connected to a part that is made of soft-magnetic material and that one or a plurality of electromagnets are disposed about the rotating knife-disc, which magnets exert a force on the soft-iron parts connected to the knives and thus can move the knives.

Another feature or aspect of an embodiment is believed at the time of the filing of this patent application to possibly reside broadly in the device characterized in that as electromagnet a concentric ring made of soft-magnetic material is disposed about the knife-disc, in the U-shaped cross-section of which ring is disposed a coil.

Yet another feature or aspect of an embodiment is believed at the time of the filing of this patent application to possibly reside broadly in the device characterized in that the knives are moved into the cutting position due to magnetic force upon the electromagnets carrying a current.

Still another feature or aspect of an embodiment is believed at the time of the filing of this patent application to possibly reside broadly in the device characterized in that the knives are moved back into the rest position by a spring upon the electromagnets not carrying a current.

A further feature or aspect of an embodiment is believed at the time of the filing of this patent application to possibly reside broadly in the device characterized in that the knives are moved back into the rest position by centrifugal force upon the electromagnets not carrying a current.

Another feature or aspect of an embodiment is believed at the time of the filing of this patent application to possibly reside broadly in the device characterized in that the knife-disc rotates with a constant number of revolutions.

The components disclosed in the various publications, disclosed or incorporated by reference herein, may possibly be used in possible embodiments of the present invention, as well as equivalents thereof.

Some examples of bottling systems that may possibly be utilized or possibly adapted for use in at least one possible embodiment of the present application may possibly be found in the following U.S. patents, all assigned to the Assignee herein, namely: U.S. Pat. No. 4,911,285; No. 4,944,830; No. 4,950,350; No. 4,976,803; No. 4,981,547; No. 5,004,518; No. 5,017,261; No. 5,062,917; No. 5,062,918; No. 5,075,123; No. 5,078,826; No. 5,087,317; No. 5,110,402; No. 5,129,984; No. 5,167,755; No. 5,174,851; No. 5,185,053; No. 5,217,538; No. 5,227,005; No. 5,413,153; No. 5,558,138; No. 5,634,500; No. 5,713,403; No. 6,276,113; No. 6,213,169; No. 6,189,578; No. 6,192,946; No. 6,374,575; No. 6,365,054; No. 6,619,016; No. 6,474,368; No. 6,494,238; No. 6,470,922; and No. 6,463,964.

The purpose of the statements about the technical field is generally to enable the Patent and Trademark Office and the public to determine quickly, from a cursory inspection, the nature of this patent application. The description of the technical field is believed, at the time of the filing of this patent application, to adequately describe the technical field of this patent application. However, the description of the technical field may not be completely applicable to the claims as originally filed in this patent application, as amended during prosecution of this patent application, and as ultimately allowed in any patent issuing from this patent application. Therefore, any statements made relating to the technical field are not intended to limit the claims in any manner and should not be interpreted as limiting the claims in any manner.

Some examples of methods and apparatuses for closing bottles and containers and their components that may possibly be utilized or possibly adapted for use in at least one possible embodiment of the present may possibly be found in the following U.S. patents: U.S. Pat. No. 5,398,485 issued to Osifchin on Mar. 21, 1995; U.S. Pat. No. 5,402,623 issued to Ahlers on Apr. 4, 1995; U.S. Pat. No. 5,419,094 issued to Vander Bush, Jr. et al. on May 30, 1995; U.S. Pat. No. 5,425,402 issued to Pringle on Jun. 20, 1995; U.S. Pat. No. 5,447,246 issued to Finke on Sep. 5, 1995; and U.S. Pat. No. 5,449,080 issued to Finke on Sep. 12, 1995.

The appended drawings in their entirety, including all dimensions, proportions and/or shapes in at least one embodiment of the invention, are accurate and are hereby included by reference into this specification.

The background information is believed, at the time of the filing of this patent application, to adequately provide background information for this patent application. However, the background information may not be completely applicable to the claims as originally filed in this patent application, as amended during prosecution of this patent application, and as ultimately allowed in any patent issuing from this patent application. Therefore, any statements made relating to the background information are not intended to limit the claims in any manner and should not be interpreted as limiting the claims in any manner.

Some examples of apparatus and methods of attaching sleeve labels that may possibly be utilized or possibly adapted for use in at least one possible embodiment of the present application may possibly be found in the following U.S. patents: U.S. Pat. No. 4,108,705 issued to Hadl et al. on Aug. 22, 1978; U.S. Pat. No. 4,357,788 issued to Amberg on Nov. 9, 1982; U.S. Pat. No. 5,415,721 issued to Nickey et al. on May 16, 1995; U.S. Pat. No. 5,422,152 issued to Langeland et al. on Jun. 6, 1995; U.S. Pat. No. 5,483,783 issued to Lerner et al. on Jan. 16, 1996; U.S. Pat. No. 5,775,019 issued to Johnson on Jul. 7, 1998; U.S. Pat. No. 6,543,514 issued to Menayan on Apr. 8, 2003; and U.S. Pat. No. 6,523,328 issued to De Cardenas et al. on Feb. 25, 2003.

All, or substantially all, of the components and methods of the various embodiments may be used with at least one embodiment or all of the embodiments, if more than one embodiment is described herein.

The corresponding foreign and international patent publication applications, namely, Federal Republic of Germany Patent Application No. DE P 103 09 459.8, filed on Mar. 5, 2003, having inventor Horst LÖFFLER, and DE-OS 103 09 459, and DE-PS 103 09 459 as well as their published equivalents, and other equivalents or corresponding applications, if any, in corresponding cases in Germany and elsewhere, and the references and documents cited in any of the documents cited herein, such as the patents, patent applications and publications, are hereby incorporated by reference as if set forth in their entirety herein.

The purpose of the statements about the object or objects is generally to enable the Patent and Trademark Office and the public to determine quickly, from a cursory inspection, the nature of this patent application. The description of the object or objects is believed, at the time of the filing of this patent application, to adequately describe the object or objects of this patent application. However, the description of the object or objects may not be completely applicable to the claims as originally filed in this patent application, as amended during prosecution of this patent application, and as ultimately allowed in any patent issuing from this patent application. Therefore, any statements made relating to the object or objects are not intended to limit the claims in any manner and should not be interpreted as limiting the claims in any manner.

The co-pending U.S. patent application Ser. No. 10/653,617 filed on Sep. 2, 2003 having inventors Klaus KRÄMER and Lutz DECKERT, having the title "Labeling machine with a sleeve mechanism for preparing and applying cylindrical labels onto beverage bottles and other beverage containers in a beverage container filling plant," and having attorney docket No. NHL-HOL-60 and its German priority patent application No. DE P 102 40 520.3, filed on Sep. 3, 2002, having inventors Klaus KRÄMER and Lutz DECKERT and other equivalents or corresponding applications, if any, in corresponding cases in Germany and elsewhere, and the references and documents cited in any of the documents cited therein, such as the patents, patent applications and publications, are hereby incorporated by reference as if set forth in their entirety herein.

Some examples of control rollers that may possibly be utilized or possibly adapted for use in at least one possible embodiment of the present application may possibly be found in the following U.S. patents: U.S. Pat. No. 4,081,149 issued to Miller on Mar. 28, 1978; U.S. Pat. No. 4,732,374 issued to Honegger on Mar. 22, 1988; U.S. Pat. No. 4,756,520 issued to Clark, Jr. et al. on Jul. 12, 1988; U.S. Pat. No. 5,265,313 issued to Rutz on Nov. 30, 1993; U.S. Pat. No. 5,402,556 issued to Rutz on Apr. 4, 1995; U.S. Pat. No. 6,037,739 issued to Hartramph et al. on Mar. 14, 2000.

The co-pending U.S. patent application Ser. No. 10/780,280, filed on Feb. 17, 2004 having inventor Heinz-Michael ZWILLING, having the title "A beverage bottling plant for filling bottles with a liquid beverage filling material, a container filling plant container information adding station, such as, a labeling station, configured to add information to containers, such as, bottles and cans, and modules for labeling stations", and having attorney docket No. NHL-HOL-65 and its German priority patent application No. DE P 103 06 671, filed on Feb. 18, 2003, having inventor Heinz-Michael ZWILLING and other equivalents or corresponding applications, if any, in corresponding cases in Germany and elsewhere, and the references and documents cited in any of the documents cited therein, such as the patents, patent applications and publications, are hereby incorporated by reference as if set forth in their entirety herein.

All of the patents, patent applications and publications recited herein, and in the Declaration attached hereto, are hereby incorporated by reference as if set forth in their entirety herein.

German patent application No. DE P 103 14 635, filed on Apr. 1, 2003, having inventor Lutz DECKERT, and other equivalents or corresponding applications, if any, in corresponding cases in Germany and elsewhere, and the references and documents cited in any of the documents cited therein, such as the patents, patent applications and publications, are hereby incorporated by reference as if set forth in their entirety herein.

The summary is believed, at the time of the filing of this patent application, to adequately summarize this patent application. However, portions or all of the information contained in the summary may not be completely applicable to the claims as originally filed in this patent application, as amended during prosecution of this patent application, and as ultimately allowed in any patent issuing from this patent application. Therefore, any statements made relating to the summary are not intended to limit the claims in any manner and should not be interpreted as limiting the claims in any manner.

Some examples of expanding mandrel structures that my possibly be utilized or possibly adapted for use in at least one possible embodiment of the present application may possibly be found in the following U.S. patents: U.S. Pat. No. 4,936,130 issued to Kramer on Jun. 26, 1990; U.S. Pat. No. 4,840,360 issued to Bartley on Jun. 20, 1989; U.S. Pat. No. 4,229,014 issued to Crowe on Oct. 21, 1980; U.S. Pat. No. 5,009,002 issued to Kelly on Apr. 23, 1991; U.S. Pat. No. 5,685,190 issued to Yamamoto et al. on Nov. 11, 1997; and U.S. Pat. No. 6,435,520 issued to Barbieux on Aug. 20, 2002.

All of the references and documents, cited in any of the documents cited herein, are hereby incorporated by reference as if set forth in their entirety herein. All of the documents cited herein, referred to in the immediately preceding sentence, include all of the patents, patent applications and publications cited anywhere in the present application.

Some examples of expanding mandrel structures using lever action that may possibly be utilized or possibly adapted for use in at least one possible embodiment of the present application may possibly be found in the following U.S. patents: U.S. Pat. No. 4,144,735 issued to Rothenberger on Mar. 20, 1979; U.S. Pat. No. 4,214,860 issued to Kleimenhagen et al. on Jul. 29, 1980; U.S. Pat. No. 4,936,130 issued to Kramer on Jun. 26, 1990; U.S. Pat. No. 5,046,349 issued to Velte on Sep. 10, 1991 and U.S. Pat. No. 5,243,845 issued to Velte on Sep. 14, 1993.

The description of the embodiment or embodiments is believed, at the time of the filing of this patent application, to adequately describe the embodiment or embodiments of this patent application. However, portions of the description of the embodiment or embodiments may not be completely applicable to the claims as originally filed in this patent application, as amended during prosecution of this patent application, and as ultimately allowed in any patent issuing from this patent application. Therefore, any statements made relating to the embodiment or embodiments are not intended to limit the claims in any manner and should not be interpreted as limiting the claims in any manner.

Some examples of expanding mandrel structures using pneumatic action that may possibly be utilized or possibly adapted for use in at least one possible embodiment of the present application may possibly be found in the following U.S. patents: U.S. Pat. No. 4,144,735 issued to Rothenberger on Mar. 20, 1979, U.S. Pat. No. 5,009,002 issued to Kelly on Apr. 23, 1991; and U.S. Pat. No. 5,062,199 issued to Kelly on Nov. 5, 1991.

The details in the patents, patent applications and publications may be considered to be incorporable, at applicant's option, into the claims during prosecution as further limitations in the claims to patentably distinguish any amended claims from any applied prior art.

Some examples of expanding mandrel structures using hydraulic action that may possibly be utilized or possibly adapted for use in at least one possible embodiment of the present application may possibly be found in the following U.S. patents: U.S. Pat. No. 3,938,235 issued to Wendt, III et al. on Feb. 17, 1976; U.S. Pat. No. 4,124,173 issued to Damour on Nov. 7, 1978; U.S. Pat. No. 4,387,845 issued to Mefferd on Jun. 14, 1983; U.S. Pat. No. 4,665,732 issued to Hogenhout on May 19, 1987; U.S. Pat. No. 5,243,845 issued to Velte on Sep. 14, 1993; and U.S. Pat. No. 5,685,190 issued to Yamamoto et al. an Nov. 11, 1997.

The purpose of the title of this patent application is generally to enable the Patent and Trademark Office and the public to determine quickly, from a cursory inspection, the nature of this patent application. The title is believed, at the time of the filing of this patent application, to adequately reflect the general nature of this patent application. However, the title may not be completely applicable to the technical field, the object or objects, the summary, the description of the embodiment or embodiments, and the claims as originally filed in this patent application, as amended during prosecution of this patent application, and as ultimately allowed in any patent issuing from this patent application. Therefore, the title is not intended to limit the claims in any manner and should not be interpreted as limiting the claims in any manner.

Some examples of expanding mandrel structures using electromagnetic force that may possibly be utilized or possibly adapted for use in at least one possible embodiment of the present application may possibly be found in the following U.S. patents: U.S. Pat. No. 4,688,139 issued to Nagata et al. on Aug. 18, 1987; U.S. Pat. No. 5,259,672 issued to Rowe on Nov. 9, 1993; U.S. Pat. No. 6,044,705 issued to Neukermans et al. on Apr. 4, 2000; U.S. Pat. No. 6,516,758 issued to Leiber on Feb. 11, 2003; and U.S. Pat. No. 6,556,737 issued to Miu et al. on Apr. 29, 2003.

The abstract of the disclosure is submitted herewith as required by 37 C.F.R. §1.72(b). As stated in 37 C.F.R. §1.72(b):

A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims.

Therefore, any statements made relating to the abstract are not intended to limit the claims in any manner and should not be interpreted as limiting the claims in any manner.

Some examples of microprocessors that may possibly be utilized or possibly adapted for use in at least one possible embodiment of the present application may possibly be found in the following U.S. patents: U.S. Pat. No. 6,095,987 issued to Shmulewitz et al. on Aug. 1, 2000; U.S. Pat. No. 6,516,331 issued to Beiu on Feb. 4, 2003; U.S. Pat. No. 6,522,981 issued to Smit et al. on Feb. 18, 2003; U.S. Pat. No. 6,539,502 issued to Davidson et al. on Mar. 25, 2003; U.S. Pat. No. 6,553,460 issued to Chopra et al. on Apr. 22, 2003; U.S. Pat. No. 6,557,098 issued to Oberman et al. on Apr. 29, 2003; U.S. Pat. No. 6,571,363 issued to Steiss on May 27, 2003; and U.S. Pat. No. 6,574,724 issued to Hoyle et al. on Jun. 3, 2003.

Some examples of cutting apparatus that may possibly be utilized or possibly adapted for use in at least one possible embodiment of the present may possibly be found in the following U.S. patents: U.S. Pat. No. 5,060,367 issued to Vandevoorde on Oct. 29, 1991; U.S. Pat. No. 5,091,237 issued to Scloegl et al. on Feb. 25, 1992; U.S. Pat. No. 5,715,651 issued to Thebault on Feb. 10, 1998; U.S. Pat. No. 5,916,343 issued to Huang et al. on Jun. 29, 1999; U.S. Pat. No. 6,502,488 issued to Taylor on Jan. 7, 2003; and U.S. Pat. No. 6,684,599 issued to Fresnel on Feb. 3, 2004.

Some examples of soft magnetic materials that may possibly be utilized or possibly adapted for use in at least one possible embodiment of the present may possibly be found in the following U.S. patents: U.S. Pat. No. 6,132,891 issued to Kumura et al. on Oct. 17, 2000; U.S. Pat. No. 6,190,465 issued to Coutu et al. on Feb. 20, 2001; U.S. Pat. No. 6,312,531 issued to Matsutani et al. on Nov. 6, 2001; U.S. Pat. No. 6,337,007 issued to Osaka on Jan. 8, 2002; U.S. Pat. No. 6,419,877 issued to Elgelid et al. on Jul. 16, 2002; U.S. Pat. No. 6,485,579 issued to Nilius et al on Nov. 26, 2002; and U.S. Pat. No. 6,620,376 issued to Koch et al. on Sep. 16, 2003.

Some examples of permanent magnets that may possibly be utilized or possibly adapted for use in at least one possible embodiment of the present application may possibly be found in the following U.S. patents: U.S. Pat. No. 6,464,934 issued to Schrey et al. on Oct. 15, 2002; U.S. Pat. No. 6,468,365 issued to Uchida et al. on Oct. 22, 2002; U.S. Pat. No. 6,475,302 issued to Mei et al. on Nov. 5, 2002; U.S. Pat. No. 6,506,265 issued to Yamamoto et al. on Jan. 14, 2003; U.S. Pat. No. 6,555,940 issued to Naito et al. on Apr. 29, 2003; and U.S. Pat. No. 6,662,434 issued to Laskaris on Dec. 16, 2003.

Some examples of electromagnets that may possibly be utilized or possibly adapted for use in at least one possible embodiment of the present application may possibly be found in the following U.S. patents: U.S. Pat. No. 4,999,559 issued to Katz on Mar. 12, 1991; U.S. Pat. No. 5,255,151 issued to Cai et al. on Oct. 19, 1993; U.S. Pat. No. 5,410,289 issued to Futa on Apr. 25, 1995; U.S. Pat. No. 6,101,082 issued to Benkaroun et al. on Aug. 8, 2000; U.S. Pat. No. 6,225,886 issued to Kleinert et al. on May 1, 2001; and U.S. Pat. No. 6,236,043 issued to Tadokoro et al. on May 22, 2001.

Some examples of arrangements of magnets in circular arrangements that may possibly be utilized or possibly adapted for use in at least one possible embodiment of the present application may possibly be found in the following U.S. patents: U.S. Pat. No. 4,110,646 issued to Rao on Aug. 29, 1978; U.S. Pat. No. 5,861,789 issued to Bundy et al. on Jan. 19, 1999; U.S. Pat. No. 6,019,859 issued to Kanekiyo et al. on Feb. 1, 2000; U.S. Pat. No. 6,049,148 issued to Nichols et al. on Apr. 11, 2000; U.S. Pat. No. 6,354,536 issued to Torok et al. on Mar. 12, 2002; U.S. Pat. No. 6,435,948 issued to Molnar on Aug. 20, 2002; and U.S. Pat. No. 6,680,553 issued to Takano on Jan. 20, 2004.

It will be understood that the examples of patents, published patent applications, and other documents which are included in this application and which are referred to in paragraphs which state "Some examples of . . . which may possibly be used in at least one possible embodiment of the present application . . . " may possibly not be used or useable in any one or more embodiments of the application.

The sentence immediately above relates to patents, published patent applications and other documents either incorporated by reference or not incorporated by reference.

Thus, one feature or aspect of an embodiment is believed at the time of the filing of this patent application to possibly reside broadly in a rotating device for defined and rapid cutting of labels that are introduced as endless tube. The device comprises a knife carrier. Such knife carrier, for example, in one embodiment, comprises a rotating disc that rotates with a constant number of revolutions, which disc has one or a plurality of knives, that each can be moved between a rest position and a cutting position. Each knife is connected to a part that is made of soft-magnetic material and one or a plurality of electromagnets are disposed about the rotating knife-disc, which magnets exert a force on the soft-iron parts connected to the knives and thus can move the knives between the rest position and the cutting position. The knives are returned either by a spring or centrifugal force to the starting position.

The embodiments of the invention described herein above in the context of the preferred embodiments are not to be taken as limiting the embodiments of the invention to all of the provided details thereof, since modifications and variations thereof may be made without departing from the spirit and scope of the embodiments of the invention.

What is claimed is:

1. A beverage bottling plant for filling beverage bottles with liquid beverage material, said beverage bottling plant comprising:

a plurality of rotary machines comprising at least a rotary beverage bottle filling machine, a rotary beverage bottle closing machine, and a rotary beverage bottle labeling machine;

a first conveyor arrangement being configured and disposed to convey beverage bottles to be filled to said beverage bottle filling machine;

said beverage bottle filling machine being configured and disposed to fill beverage bottles with liquid beverage material;

said beverage bottle filling machine comprising:

a rotor;

a rotatable vertical machine column;

said rotor being connected to said vertical machine column to permit rotation of said rotor about said vertical machine column;

a plurality of beverage bottle filling elements for filling beverage bottles with liquid beverage material being disposed on the periphery of said rotor;

each of said plurality of beverage bottle filling elements comprising a container carrier being configured and disposed to receive and hold beverage bottles to be filled;

each of said plurality of beverage bottle filling elements being configured and disposed to dispense liquid beverage material into beverage bottles to be filled;

at least one liquid reservoir being configured to hold a supply of liquid beverage material;

at least one supply line being configured and disposed to connect said at least one liquid reservoir to said beverage bottle filling machine to supply liquid beverage material to said beverage bottle filling machine;

a first star wheel structure being configured and disposed to move beverage bottles into said beverage bottle filling machine;

a second star wheel structure being configured and disposed to move beverage bottles out of said beverage bottle filling machine;

a second conveyor arrangement being configured and disposed to convey filled beverage bottles to said beverage bottle closing machine;

said beverage bottle closing machine being configured and disposed to close tops of filled beverage bottles;

said beverage bottle closing machine comprising:

a rotor;

a rotatable vertical machine column;

said rotor being connected to said vertical machine column to permit rotation of said rotor about said vertical machine column;

a plurality of closing devices being disposed on the periphery of said rotor;

each of said plurality of closing devices being configured and disposed to place closures on filled beverage bottles;

each of said plurality of closing devices comprising a container carrier being configured and disposed to receive and hold filled beverage bottles;

a first star wheel structure being configured and disposed to move filled beverage bottles into said beverage bottle closing machine;

a second star wheel structure being configured and disposed to move filled, closed beverage bottles out of said beverage bottle closing machine;

a third conveyor arrangement being configured and disposed to convey filled, closed beverage bottles to said beverage bottle labeling machine;

said beverage bottle labeling machine being configured and disposed to label filled, closed beverage bottles;

said beverage bottle labeling machine comprising:

a rotor;

a rotatable vertical machine column;

said rotor being connected to said vertical machine column to permit rotation of said rotor, about said vertical machine column;

a plurality of beverage bottle support structures being disposed on the periphery of said rotor;

said beverage bottle support structures being configured to support and hold filled, closed beverage bottles;

a first star wheel structure being configured and disposed to move filled, closed beverage bottles into said beverage bottle labeling machine;

a second star wheel structure being configured and disposed to move labeled beverage bottles out of said beverage bottle labeling machine;

at least one beverage bottle labeling device being configured and disposed to affix a label to the surface of a beverage bottle;

said at least one beverage bottle labeling device comprising:

a storage magazine being configured and disposed to store a continuous collapsed tube of flat uncut sleeve labels disposed sequentially one after the other;

a mandrel structure;

said mandrel structure being configured to open a continuous collapsed tube of uncut sleeve labels;

said mandrel structure having a receiving end and a discharge end remote from said receiving end;

a first roller apparatus being configured and disposed to advance an opened continuous tube of uncut sleeve labels along said mandrel structure from said receiving end towards said discharge end;

said first roller apparatus being disposed adjacent said receiving end of said mandrel structure;

a second roller apparatus being configured and disposed to advance an opened continuous tube of uncut sleeve labels along said mandrel structure to said discharge end;

said second roller apparatus being disposed between said first roller apparatus and said discharge end of said mandrel structure;

a cutting apparatus being configured and disposed to cut an open sleeve label from an opened continuous tube of uncut open sleeve labels to thus produce a cut open sleeve label for a bottle disposed at said discharge end of said mandrel structure;

said cutting apparatus comprising a rotating disc having at least one sleeve cutting knife operatively connected thereto;

said at least one sleeve cutting knife being configured and disposed to be moved between a disengaged position and an engaged, cutting position;

said at least one sleeve cutting knife comprising a portion configured to move said at least one sleeve cutting knife into the engaged, cutting position, and also comprising a structure to move said at least one sleeve cutting knife into the disengaged position;

said cutting apparatus also comprising at least one electromagnet configured and disposed to move said at least one sleeve cutting knife into the engaged, cutting position, and also being configured and disposed to move said at least one sleeve cutting knife into the disengaged position;

said cutting apparatus being disposed between said first roller apparatus and said second roller apparatus:

said mandrel structure comprising an expander apparatus being configured and disposed to sufficiently expand a portion of an uncut open sleeve label, immediately adjacent said cutting apparatus, between said first roller apparatus and said second roller apparatus, to make taut a portion of an opened tube of uncut open sleeve labels adjacent said cutting apparatus and thus to minimize bunching of an opened continuous tube of uncut open sleeve labels on said mandrel structure, and also to maximize precision of the cut being effectuated by said cutting apparatus; and said second roller apparatus also being configured and disposed to remove a cut open sleeve label from said mandrel structure with sufficient velocity and to position a cut open sleeve label about a bottle disposed at said discharge end of said mandrel structure, and thus to permit a constant cut of a sleeve label being cut and elevated cutting speeds to afford shorter cycle times.

2. The beverage bottling plant according to claim 1, wherein:

said at least one sleeve cutting knife comprises a soft-magnetic material; and said at least one electromagnet Is configured to exert a force on said soft-magnetic material of said at least one sleeve cutting knife to move said at least one sleeve cutting knife into its cutting position.

3. The beverage bottling plant according to claim 2, wherein:

said at least one electromagnet comprises a ring structure disposed about and concentrically with said rotating disk;

said ring comprises a soft-magnetic material; and a coil is disposed on said ring.

4. The beverage bottling plant according to claim 3, wherein said at least one sleeve cutting knife is configured to be moved into the engaged, cutting position due to magnetic force upon said at least one electromagnet carrying a current.

5. The beverage bottling plant according to claim 3, wherein:

said cutting apparatus comprises at least one spring; and each of said at least one spring is connected to a corresponding sleeve cutting knife; and each of said at least one sleeve cutting knife is configured to be moved back into its disengaged position by its corresponding spring upon a change of current in said at least one electromagnet.

6. The beverage bottling plant according to claim 3, wherein each of said at least one sleeve cutting knife is configured to be moved back into its disengaged position by centrifugal force upon a change of current in said at least one electromagnet.

7. The beverage bottling plant according to claim 3, wherein said rotating disk is configured to rotate at a constant number of revolutions per unit of time.

8. A container filling plant for filling containers with a filling material, said container filling plant comprising:

a filling machine being configured and disposed to fill empty containers with a filling material;

a first moving arrangement being configured and disposed to move containers to said filling machine;

said filling machine comprising:

a moving device being configured and disposed to accept containers from said first moving, arrangement and to move containers within said filling machine;

an apparatus being configured and disposed to hold containers during filling; and at least one filling device being configured and disposed to fill containers with a filling material upon the containers being within said filling machine;

a closing machine being configured and disposed to close filled containers;

a second moving arrangement being configured and disposed to accept filled containers from said moving device of said filling machine to move filled containers out of said filling machine;

said second moving arrangement being configured and disposed to move filled containers from said filling machine to said closing machine;

said closing machine comprising:

a moving device being configured and disposed to accept filled containers from said second moving arrangement and to move filled containers within said closing machine;

an apparatus being configured and disposed to hold filled containers during closing; and at least one closing device being configured and disposed to close filled containers upon the filled containers being within said closing machine;

a labeling machine being configured and disposed to label closed containers;

a third moving arrangement being configured and disposed to accept closed containers from said moving device of said closing machine to move closed containers out of said closing machine;

said third moving arrangement being configured and disposed to move closed containers from said closing machine to said labeling machine;

said labeling machine comprising:

a moving device being configured and disposed to accept closed containers from said third moving arrangement and to move closed containers within said labeling machine;

at least one labeling device being configured and disposed to place labels on closed containers;

said at least one labeling device comprising:

a storage magazine being configured and disposed to store a continuous tube of uncut sleeve labels;

a mandrel structure being configured to open a continuous tube of uncut sleeve labels;

said mandrel structure having a receiving end and a discharge end remote from said receiving end;

at least one roller apparatus being configured and disposed to advance an opened continuous tube of uncut sleeve labels along said mandrel structure from said receiving end towards said discharge end;

a cutting apparatus being configured and disposed to cut an open sleeve label from an opened continuous tube of uncut open sleeve labels to thus produce a cut open sleeve label for a container disposed at said discharge end of said mandrel structure;

said cutting apparatus comprising a rotating disc having at least one sleeve cutting knife operatively connected thereto;

said at least one sleeve cutting knife being configured and disposed to be moved between an engaged, cutting position and a disengaged, non-cutting position;

said cutting apparatus comprising at least one electromagnet being configured and disposed to move said at least one sleeve cutting knife into its engaged, cutting position to cut an open sleeve label from said tube of uncut open sleeve labels, and to move said at least one sleeve cutting knife into its disengaged, non-cutting position upon cutting of an open sleeve label from said tube of uncut open sleeve labels; and a labeling apparatus being configured and disposed to affix a cut open sleeve label, positioned by said at (east one roller apparatus about a container, to the surface of a container; and a conveyer arrangement being configured and disposed to move labeled containers out of said labeling station.

9. The container filling plant according to claim 8, wherein:

said at least one sleeve cutting knife comprises a soft-magnetic material; and said at least one electromagnet is configured to exert a force on said soft-magnetic material of said at least one sleeve cutting knife to move said at least one sleeve cutting knife into its cutting position.

10. The container filling plant according to claim 9, wherein:

said at least one electromagnet comprises a ring disposed about and concentrically with said rotating disk;

said ring comprises a soft-magnetic material; and a coil is disposed on said ring.

11. The container filling plant according to claim 10, wherein said at least one sleeve cutting knife is configured to be moved into the cutting position due to magnetic force upon said at least one electromagnet carrying a current.

12. The container filling plant according to claim 10, wherein:

said cutting apparatus comprises at least one spring; and each of said at least one spring is connected to a corresponding sleeve cutting knife; and each of said at least one sleeve cutting knife is configured to be moved back into its disengaged position by its corresponding spring upon a change of current in said at least one electromagnet.

13. The container filling plant according to claim 10, wherein each of said at least one sleeve cutting knife is configured to be moved back into its disengaged position by centrifugal force upon a change of current in said at least one electromagnet.

14. The container filling plant according to claim 10, wherein said rotating disk is configured to rotate at a constant number of revolutions per unit of time.

15. A container filling plant for filling containers with a filling material, said container filling plant comprising:

a filling machine being configured and disposed to fill empty containers with a filling material;

a first moving arrangement being configured and disposed to move containers to said filling machine:

said filling machine comprising:

a moving device being configured and disposed to accept containers from said first moving arrangement and to move containers within said filling machine;

an apparatus being configured and disposed to hold containers during filling; and at least one filling device being configured and disposed to fill containers with a filling material upon the containers being within said filling machine;

a closing machine being configured and disposed to close filled containers;

a second moving arrangement being configured and disposed to accept filled containers from said moving device of said filling machine to move filled containers out of said filling machine;

said second moving arrangement being configured and disposed to move filled containers from said filling machine to said closing machine;

said closing machine comprising:

a moving device being configured and disposed to accept filled containers from said second moving arrangement and to move filled containers within said closing machine;

an apparatus being configured and disposed to hold filled containers during closing; and at least one closing device being configured and disposed to close filled containers upon the filled containers being within said closing machine;

a labeling machine being configured and disposed to label closed containers;

a third moving arrangement being configured and disposed to accept closed containers from said moving device of said closing machine to move closed containers out of said closing machine;

said third moving arrangement being configured and disposed to move closed containers from said closing machine to said labeling machine;

said labeling machine comprising:

a moving device being configured and disposed to accept closed containers from said third moving arrangement and to move closed containers within said labeling machine;

at least one labeling device being configured and disposed to place labels on closed containers;

said at least one labeling device comprising:

a magazine being configured and disposed to store a continuous collapsed tube of uncut sleeve labels;

an arrangement being configured and disposed to open the continuous collapsed tube of uncut sleeve labels;

a cutting device being configured and disposed to cut an open sleeve label from the opened tube of uncut open sleeve labels;

said cutting device comprising:

a rotatable structure;

at least one sleeve cutting knife being operatively connected to said rotatable structure;

said at least one sleeve cutting knife being configured and disposed to be moved between a cutting position and a non-cutting position; and at least one electromagnet being configured and disposed to move said at least one sleeve cutting knife into its cutting position to cut an open sleeve label from said tube of uncut open sleeve labels; and an apparatus being configured and disposed to place a cut open sleeve label on a container; and a fourth moving arrangement being configured and disposed to accept labeled containers from said moving device of said labeling machine to move labeled containers out of said labeling machine.

16. The container filling plant according to claim 15, wherein:

said at least one sleeve cutting knife comprises a soft-magnetic material; and said at least one electromagnet is configured to exert a force on said soft-magnetic material of said at least one sleeve cutting knife to move said at least one sleeve cutting knife into its cutting position.

17. The container filling plant according to claim 16, wherein:

said at least one electromagnet comprises a ring disposed about and concentrically with said rotatable structure;

said ring comprises a soft-magnetic material; and a coil is disposed on said ring.

18. The container filling plant according to claim 17, wherein said at least one sleeve cutting knife is configured to be moved into the cutting position due to magnetic force upon said at least one electromagnet carrying a current.

19. The container filling plant according to claim 17, wherein:

said cutting device comprises at least one spring; and each of said at least one spring is connected to a corresponding sleeve cutting knife; and each of said at least one sleeve cutting knife is configured to be moved back into its disengaged position by its corresponding spring upon a change of current in said at least one electromagnet.

20. The container filling plant according to claim 17, wherein:

each of said at least one sleeve cutting knife is configured to be moved back into its disengaged position by centrifugal force upon a change of current in said at least one electromagnet; and said rotatable structure is configured to rotate at a constant number of revolutions per unit of time.

* * * * *

UNITED STATES PATENT AND TRADEMARK OFFICE

CERTIFICATE OF CORRECTION

PATENT NO. : 7,062,894 B2
APPLICATION NO. : 10/793659
DATED : June 20, 2006
INVENTOR(S) : Horst Löffler It is certified that error appears in the above-identified patent and that said Letters Patent is hereby corrected as shown below:

On Title page Item (73) Assignee: delete “Anlabenbau” and insert --Anlagenbau--.

Column 16, line 52, Claim 1, after “said”, delete “rotor,” and insert --rotor--.

Column 18, line 9, Claim 2, after “electromagnet”, delete “Is” and insert --is--

Column 18, line 51, Claim
8, after “first”, delete “moving,” and insert --moving--.

Column 19, line 64, Claim 8, after “at”, delete “(east” and insert --least--.

Signed and Sealed this

Twelfth Day of December, 2006

JON W. DUDAS
*Director of the United States Patent and Trademark Office*